US008997857B2

(12) United States Patent
Wubben et al.

(10) Patent No.: US 8,997,857 B2
(45) **Date of Patent: *Apr. 7, 2015**

(54) SYSTEM AND METHOD FOR ANCHORING AN EXPANDABLE TUBULAR TO A BOREHOLE WALL

(75) Inventors: Antonius Leonardus Maria Wubben, Rijswijk (NL); Djurre Hans Zijsling, Rijswijk (NL)

(73) Assignee: Enventure Global Technology, LLC, Houston, TX (US)

( * ) Notice: Subject to any disclaimer, the term of this patent is extended or adjusted under 35 U.S.C. 154(b) by 505 days.

This patent is subject to a terminal disclaimer.

(21) Appl. No.: 13/392,586

(22) PCT Filed: Aug. 26, 2010

(86) PCT No.: PCT/EP2010/062443

§ 371 (c)(1),
(2), (4) Date: Feb. 27, 2012

(87) PCT Pub. No.: WO2011/023742

PCT Pub. Date: Mar. 3, 2011

(65) Prior Publication Data

US 2012/0152526 A1 Jun. 21, 2012

Related U.S. Application Data

(60) Provisional application No. 61/237,834, filed on Aug. 28, 2009.

(51) Int. Cl.
*E21B 43/10* (2006.01)
*E21B 23/01* (2006.01)

(52) U.S. Cl.
CPC ..... *E21B 23/01* (2013.01); *E21B 43/103* (2013.01); *E21B 43/105* (2013.01)

(58) Field of Classification Search
USPC ..... 166/207, 208, 216, 217, 382, 277; 72/208, 209, 393
See application file for complete search history.

(56) References Cited

U.S. PATENT DOCUMENTS 4,288,082 A 9/1981 Setterberg et al.
6,622,789 B1 9/2003 Braddick ..... 166/277

(Continued)

FOREIGN PATENT DOCUMENTS

CN 101111661 1/2008
CN 1784534 5/2008

(Continued)

OTHER PUBLICATIONS

Search Report dated Apr. 1, 2011 for corresponding International Application No. PCT/EP2010/062443 (4 pgs.).

(Continued)

*Primary Examiner* — Daniel P Stephenson
*Assistant Examiner* — Wei Wang
(74) *Attorney, Agent, or Firm* — Derek V. Forinash; Porter Hedges LLP

(57) ABSTRACT

The present invention provides a system for anchoring an expandable tubular to a borehole wall. The system comprises a support member having a first end fixed relative to the outside of the tubular and a second end comprising a ramping surface. An anchor member has a first end fixed relative to the outside of the tubular and a second end extending toward the support member, said second end being movable relative to the outside of the tubular. Said support member includes a ramp surface that tapers in the direction of said anchor member. Expansion of the portion of the expandable tubular between the first support end and the first anchor end causes the axial device length to shorten, wherein the difference in length is sufficient to cause the second anchor end to move radially outward and engage the borehole wall as a result of engagement with said ramping surface.

12 Claims, 8 Drawing Sheets

(56) References Cited

U.S. PATENT DOCUMENTS

| | | | | |
|---|---|---|---|---|
| 6,789,622 | B1 | 9/2004 | Ducasse et al. | |
| 6,827,150 | B2 | 12/2004 | Luke | |
| 6,877,567 | B2 | 4/2005 | Hirth | |
| 7,036,581 | B2 | 5/2006 | Trahan | |
| 7,104,322 | B2 | 9/2006 | Whanger et al. | 166/277 |
| 7,156,182 | B2 | 1/2007 | Lynde et al. | |
| 7,410,001 | B2 | 8/2008 | Harrall et al. | |
| 7,543,639 | B2 | 6/2009 | Emerson | |
| 7,614,449 | B2 | 11/2009 | Anderson | |
| 2004/0244992 | A1 | 12/2004 | Carter et al. | |
| 2006/0000617 | A1 | 1/2006 | Harrall et al. | |
| 2006/0124295 | A1 | 6/2006 | Maguire | 166/207 |
| 2006/0162921 | A1 | 7/2006 | Carmody et al. | 166/217 |
| 2006/0272807 | A1 | 12/2006 | Adam et al. | |
| 2006/0272827 | A1 | 12/2006 | Adam et al. | |
| 2007/0007015 | A1 | 1/2007 | Thornton | |
| 2007/0068671 | A1 | 3/2007 | Lohbeck | 166/207 |
| 2007/0114019 | A1 | 5/2007 | Brezinski et al. | |
| 2007/0114044 | A1 | 5/2007 | Brezinski et al. | |
| 2007/0158081 | A1 | 7/2007 | Harrall et al. | |
| 2007/0199719 | A1 | 8/2007 | MacKenzie | |
| 2008/0053656 | A1 | 3/2008 | Lynde | |
| 2008/0066927 | A1 | 3/2008 | Costa et al. | |
| 2008/0302543 | A1 | 12/2008 | O'Connor et al. | |
| 2009/0014172 | A1 | 1/2009 | Costa et al. | 166/207 |
| 2009/0151930 | A1 | 6/2009 | Giroux | 166/207 |
| 2009/0308594 | A1 | 12/2009 | Lohbeck | |
| 2011/0048699 | A1 | 3/2011 | Wubben et al. | |

FOREIGN PATENT DOCUMENTS

| | | |
|---|---|---|
| CN | 101210485 | 6/2012 |
| EP | 2456949 | 5/2012 |
| GB | 2484875 | 4/2012 |
| GB | 2485504 | 5/2012 |
| WO | 2011023742 | 3/2011 |
| WO | 2011023743 | 3/2011 |
| WO | 2011023744 | 3/2011 |

OTHER PUBLICATIONS

Search Report dated Apr. 1, 2011 for corresponding International Application No. PCT/EP2010/062444 (4 pgs.).
Search Report dated Apr. 1, 2011 for corresponding International Application No. PCT/EP2010/062445 (4 pgs.).
Written Opinion dated Feb. 28, 2012 for corresponding International Application No. PCT/EP2010/062443 (5 pgs.).
Written Opinion dated Feb. 28, 2012 for corresponding International Application No. PCT/EP2010/062444 (5 pgs.).
Written Opinion dated Feb. 28, 2012 for corresponding International Application No. PCT/EP2010/062445 (5 pgs.).
International Report of Patentability dated Feb. 28, 2012 for corresponding International Application No. PCT/EP2010/062443 (6 pgs.).
International Report of Patentability dated Feb. 28, 2012 for corresponding International Application No. PCT/EP2010/062444 (6 pgs.).
International Report of Patentability dated Feb. 28, 2012 for corresponding International Application No. PCT/EP2010/062445 (6 pgs.).
United Kingdom Examination Report dated Apr. 5, 2013 for corresponding United Kingdom Application No. GB1202610.0 (2 pgs.).
Notice of Allowance dated May 9, 2013 for corresponding U.S. Appl. No. 12/869,523 (6 pgs.).
Office Action dated Jan. 2, 2013 for corresponding U.S. Appl. No. 12/869,523 (16 pgs.).
Office Action dated Oct. 26, 2011 for corresponding U.S. Appl. No. 12/869,523 (11 pgs.).
Office Action dated Jan. 13, 2012 for corresponding U.S. Appl. No. 12/869,523 (14 pgs.).
Chinese Office Action dated Nov. 28, 2013 for corresponding Chinese Application No. 201080038186.X (7 pgs.).

SYSTEM AND METHOD FOR ANCHORING AN EXPANDABLE TUBULAR TO A BOREHOLE WALL

PRIORITY CLAIM

The present application claims priority to PCT Application EP2010/062443, filed 26 Aug. 2010, which in turn claims priority from U.S. Application 61/237,834, filed 28 Aug. 2009.

FIELD OF THE INVENTION

The present invention relates to an expandable assembly for use in a wellbore formed in an earth formation, the assembly comprising a mechanism for increased radial expansion upon expansion. More particularly, the invention relates to a radially expandable device that mechanically engages a borehole wall so as to form an anchor.

BACKGROUND OF THE INVENTION

In the drilling of oil and gas wells, a wellbore is formed using a drill bit that is urged downwardly at a lower end of a drill string. After drilling a predetermined depth, the drill string and bit are removed, and the wellbore is typically lined with a string of steel pipe called casing. The casing provides support to the wellbore and facilitates the isolation of certain areas of the wellbore, for instance adjacent hydrocarbon bearing formations. The casing typically extends down the wellbore from the surface of the well to a designated depth. An annular area is thus defined between the outside of the casing and the earth formation. This annular area is filled with cement to permanently set the casing in the wellbore and to facilitate the isolation of production zones and fluids at different depths within the wellbore.

Expandable tubular elements are finding increasing application in the context of hydrocarbon drilling and production. A main advantage of expandable tubular elements in wellbores relates to the increased available internal diameter downhole for fluid production or for the passage of tools, compared to conventional wellbores with a more traditional nested casing scheme. Generally, an expandable tubular element is installed by lowering the unexpanded tubular element into the wellbore, whereafter an expansion device is pushed, pumped or pulled through the tubular element. The expansion ratio, being the ratio of the diameter after expansion to the diameter before expansion, is determined by the effective diameter of the expander.

When an expandable tubular is run into a wellbore, it must be anchored within the wellbore at the desired depth to prevent movement of the expandable tubular during the expansion process. Anchoring the expandable tubular within the wellbore allows expansion of the length of the expandable tubular into the wellbore by an expander tool. The anchor must provide adequate engagement between the expandable tubular and the inner diameter of the wellbore to stabilize the expandable tubular against rotational and longitudinal axial movement within the wellbore during the expansion process.

The expandable tubular is often run into the wellbore after previous strings of casing are already set within the wellbore. The expandable tubular must be run through the inner diameter of the previous strings of casing to reach the portion of the open hole wellbore slated for isolation, which is located below the previously set strings of casing. Accordingly, the outer diameter of the anchor and the expandable tubular must be smaller than all previous casing strings lining the wellbore in order to run through the liner to the depth at which the open hole wellbore exists.

Additionally, once the expandable tubular reaches the open hole portion of the wellbore below the previous casing or liner, the inner diameter of the open hole portion of the wellbore is often larger than the inner diameter of the previous casing. To hold the expandable tubular in place within the open hole portion of the wellbore, the anchor must have a large enough outer diameter to sufficiently fix the expandable tubular at a position within the open hole wellbore before continuing with the expansion process.

U.S. Pat. No. 7,104,322 discloses a method and apparatus for anchoring an expandable tubular within a wellbore. The apparatus includes a deployment system comprising an inflatable packing element. The packing is arranged inside the liner and is supported on the drill string. When inflated, the packing radially expands an anchoring portion of the expandable tubular. The outside of the anchoring portion engages the wellbore wall and forms an anchor. The remainder of the expandable tubular can subsequently be expanded using an expander tool. The holding power and shape of the anchoring portion may be manipulated by altering the characteristics of the packer such as the shape and wall thickness of the packer.

However, engagement of the tubular with the formation, as disclosed in U.S. Pat. No. 7,104,322, is limited by the amount of expansion of the tubular element, which is typically constrained by the mechanical limits of the expansion device. For instance in cases where the annulus between the unexpanded tubular and the borehole wall is relatively large, the amount of available mechanical expansion may not be sufficient to cause the expanded tubular to engage the borehole wall.

In addition, although the friction between the outside of the tubular and the wellbore wall that keeps the expandable tubular in position may withstand the reactive forces induced on the expandable tubular by a rotational expansion tool, the friction may be insufficient to withstand the reactive force when pulling an expander cone through the expandable tubular. If the friction is insufficient, the expansion tool may move the expandable element in axial direction during expansion, and the unexpanded tubular may obstruct the previous casing. The unexpanded element must then be removed, at considerable costs, or the obstruction may render the wellbore useless, at even greater expense.

Thus, it remains desirable to provide a device that will mechanically engage the borehole wall upon expansion of a tubular, even in instances where the expanded tubular does not itself engage the borehole wall.

SUMMARY OF THE INVENTION

The present invention provides a tubing-mounted device that will mechanically engage a borehole wall upon expansion of a tubular, even in instances where the expanded tubular does not itself engage the borehole wall.

A system for anchoring an expandable tubular to a borehole wall according to the present invention comprises: a support member having a first support end fixed relative to the outside of the tubular; and an anchor member having a first anchor end fixed relative to the outside of the tubular and a second anchor end extending toward the support member, said second anchor end being movable relative to the outside of the tubular; said support member having a second support end including a ramp surface that tapers in the direction of said anchor member, wherein said ramp surface is axially spaced apart from said first support end by a distance $L_B$ and wherein said support member includes a brace extending between said first support end and said second support end, said brace and said second support end being movable relative to the outside of the tubular; said first anchor end and said first support end defining an initial axial device length $L_1$ therebetween; wherein $L_1$ is selected such that expansion of the portion of the expandable tubular between the first anchor end and the ramp surface of the second support end causes the axial device length to shorten to $L_2$, wherein the difference between $L_1$ and $L_2$ is sufficient to cause the second anchor end to move radially outward and engage the borehole wall as a result of engagement with said ramp surface, and wherein the tubular and brace are designed so that expansion of the portion of the expandable tubular between the ramp surface and the first support end causes the axial device length to shorten further unless the borehole wall prevents shortening, whereupon the expandable tubular will be prevented from shortening further by the brace.

The anchoring device of the invention enables the tubular and brace to be designed so that expansion of the portion of the expandable tubular between the ramp surface and the first support end causes the axial device length to shorten further unless the borehole wall prevents shortening, whereupon the expandable tubular will be prevented from shortening further by the brace. The radial force exerted on the tubular wall can thus be limited to a predetermined maximum radial force, so that collapse of the tubular wall during expansion can be prevented.

BRIEF DESCRIPTION OF THE DRAWINGS

The present invention is better understood by reading the following description of non-limitative embodiments with reference to the attached drawings, wherein like parts of each of the figures are identified by the same reference characters, and which are briefly described as follows.

DETAILED DESCRIPTION OF THE INVENTION

Figure 1:
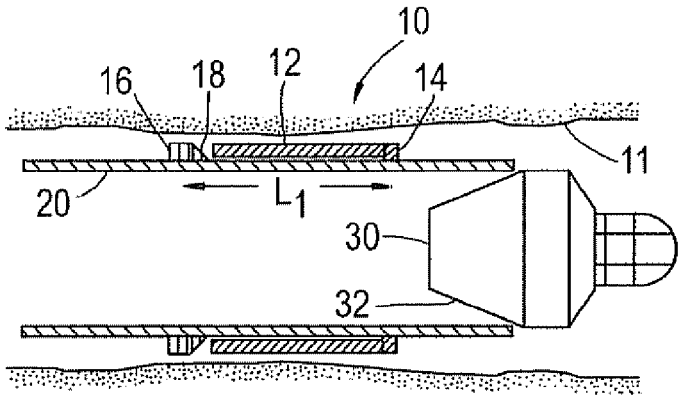
FIG. 1 is a schematic cross-section of a first embodiment of the invention positioned in a borehole before being expanded.

FIG. 1 shows an expandable anchoring device 10 for anchoring an expandable tubular 20 to a borehole wall 11 constructed in accordance with a first embodiment of the present invention. The anchoring device 10 comprises an anchor 12 and a wedging member 16 both mounted on the outside of an expandable tubular 20 and separated by a first distance $L_1$. The expandable tubular 20 may include a single tubular element, or any number of interconnected tubular elements. The tubular elements can be interconnected using threaded connections known in the art (not shown). Anchor 12 includes a fixed end 14 that is preferably affixed to tubular 20 by welding or other means that prevents relative movement between fixed end 14 and tubular 20. The other end of anchor 12 extends toward wedging member 16 but is not affixed to the outside of tubular 20, so that all of anchor 12 except fixed end 14 is free to move relative to tubular 20. Anchor 12 may be constructed such that its inner diameter is the same as or, more preferably, greater than the unexpanded outside diameter of tubular 20.

It will be understood that anchor 12 and fixed end 14 can be formed as a single, integral component, constructed from separate pieces that have been joined, or comprise separate pieces that are not mechanically joined. It is preferred that at least fixed end 14 be affixed to tubular 20, preferably but not necessarily by welding.

Similarly, wedging member 16 is preferably affixed to tubular 20 by welding or other means that prevents relative movement therebetween. Wedging member 20 includes a ramp member 18 that extends toward anchor 12. Ramp 18 may be constructed with any desired surface angle.

The thicknesses of wedging member 16 and anchor 12 are a matter of design, but are limited by the maximum allowable diameter of the system prior to expansion, which is smaller than the inner diameter of the previous casing string.

Anchor 12 and wedging member 16 can each have either an annular or segmented construction. In a segmented construction, anchor 12 and/or wedging member 16 may comprise longitudinal strips, rods, or plates. For example, eight strips, each extending around 45 degrees or less of the outer circumference of tubular 20 could be used. Alternatively, anchor 12 and/or wedging member 16 may include both an annular portion and a segmented portion. In the latter case, it is preferred that the annular portion lie outside of the separation distance $L_1$ It is further preferred that any fixed end and/or annular portion be made from a ductile material and have sufficient thickness and length that it can be expanded without requiring undue force. A suitable ductile material is for instance carbon steel A333. The material has for instance a modulus of elasticity with respect to tension in the order of 30 or more and with respect to torsion in the order of 11 or more.

Expandable anchoring device 10 is intended for use in conjunction with an expandable tubular 20, which in turn is expanded by an expansion device 30. As illustrated, expansion device 30 may comprise a cone having a frustoconical expansion surface 32 that increases the inside diameter of tubular 20 as expansion device 30 is pushed or pulled through tubular 20, but it will be understood that expansion device 30 can comprise any suitable mechanism for applying a radial expansion force to the inside of tubular 20.

Figure 2:
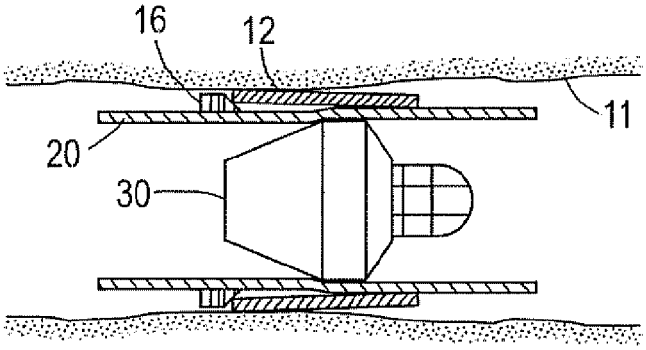
FIG. 2 is a cross-sectional view of the device of FIG. 1 in an intermediate level of expansion.
Figure 3:
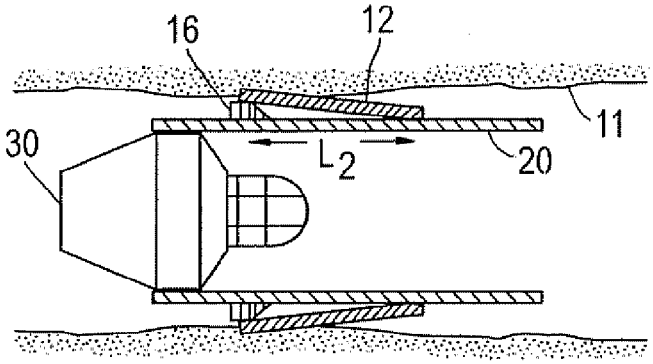
FIG. 3 is a cross-sectional view of the device of FIG. 1 fully expanded within the borehole.

Referring to FIGS. 2 and 3, it can be seen that as expansion device 30 moves through tubular 20, tubular 20 shortens.

Thus, as expansion device 30 moves from one end of $L_1$ to the other; the distance between wedging member 16 and fixed end 14 of anchor 12 decreases. The final distance between wedging member 16 and fixed end 14 of anchor 12 is reached once expansion device 30 has moved past wedging member 16, and is defined as $L_2$. Because anchor 12 is not affixed to tubular 20 apart from fixed end 14, the shortening of tubular 20 has virtually no effect on the length of anchor 12.

For a given tubular and expansion ratio, the amount of shortening that will occur if the tubular is not constrained during expansion can be predicted. In a preferred embodiment, the distance $L_1$ is selected such that the amount of shortening, which can be expressed as the difference between $L_1$ and $L_2$, is sufficient to cause the anchor 12 to overlap wedging member 16 by a desired longitudinal distance. The difference between $L_1$ and $L_2$ is a function of the expansion ratio, the expansion mode and, less so, of the original tubing wall thickness and can be predicted on the basis of those parameters.

As used herein, "expansion mode" distinguishes between so-called expansion in tension and expansion in compression, which in turn are used to describe stress states experienced by the tubular during expansion. During expansion in tension, the expansion device moves away from a location where the expandable tubular is fixed, which is for instance the position of an anchor. During expansion in compression the expansion device moves towards the location where the expandable tubular is fixed. The expandable tubular shortens approximately two times more during expansion in compression, than during expansion in tension. Shortening herein indicates the difference in length of (a section of) the tubular before and after expansion. During expansion of the tubular, the mode of expansion may change. In addition, the weight of the expandable tubular may introduce a second order effect. However, in general the mode of expansion is known, as is described in more detail below. Thus, it is possible and desirable to calculate and use a predetermined spacing $L_1$ that will result in a desired overlap and outward movement of anchor 12.

During expansion of the expandable tubular element according to the present invention, the section of the tubular that is provided with the anchor of the invention is preferably expanded in a first step. During this first step, gripping means hold the unexpanded tubular element in a predetermined position until the anchor engages the wellbore wall. Suitable gripping means that operate in conjunction with an expansion device are for instance disclosed in US-2009/0014172-A1, which is in this respect incorporated herein by reference. In a first expansion step, the gripping means engage the wall of the tubular. Than, an actuator, including for instance a hydraulic actuator, pulls the expansion device through the tubular until the anchor is activated. In a subsequent step, once the anchor has engaged the borehole wall, the remainder of the tubular element can be expanded by pulling the expansion device toward the surface. Expansion by pulling the expander toward the surface is relatively fast compared to other ways of expansion. Expansion using the gripper system can be nominated expansion in compression, wherein pulling the expander to the surface when the anchor is activated is called expansion in tension. Thus, the mode of expansion may change when the anchor is activated and engages the borehole wall.

As an alternative to the gripping system, the string of expandable tubular elements 20 can be closed at its downhole (not shown), forming a closed fluid pressure chamber between the closed end and the expansion device 30. I.e., the downhole end is closed at surface, before introducing the expandable tubular including the closed end and the expansion device in the wellbore. The expansion device 30 will be provided with a fluid passage connecting the top and bottom end thereof. For instance tubing of a hollow pipe string is connected to the top end of the fluid passage, to pass fluid under pressure from surface and through the expansion device into the fluid pressure chamber, wherein the resulting pressure in the fluid chamber pushes the expansion device through the expandable tubular. Expansion using a pressure chamber under the expansion device is called expansion in tension.

Figure 4:
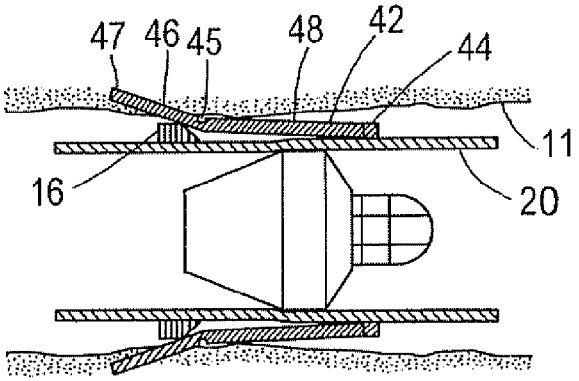
FIG. 4 is a cross-sectional view of a first alternate embodiment of the present device in an intermediate level of expansion.
Figure 5:
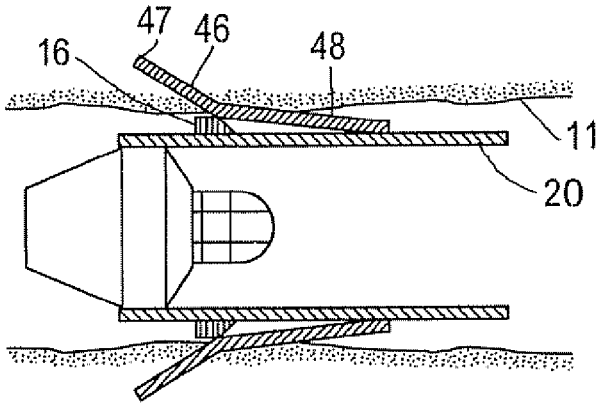
FIG. 5 is a cross-sectional view of the device of FIG. 4 fully expanded within the borehole.
Figure 6:
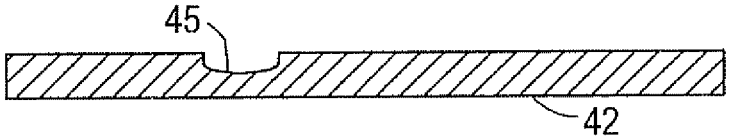
FIG. 6 is an enlarged view of an anchor suitable for use in the system of FIG. 4.

Referring now to FIGS. 4, 5, and 6, an alternative embodiment includes an anchor 42 having a fixed end 44, a first portion 46 having cutting end 47, a second portion 48, and a hinge 45 disposed between first and second portions 46, 48. Hinge 45 is provided so that anchor 42 will deform plastically during the expansion process. As wedging member 16 begins to slide under anchor 42, cutting end 47 will be pushed radially outward. Hinge 45 will provide a point of rotation for first portion 46 with respect to second portion 48, allowing cutting end 47 to rotate toward the formation.

In an embodiment, once hinge 45 has reached the limit of its rotation and/or wedging member 16 reaches hinge 45 and slides under second portion 48 of anchor 42, second portion 48 will begin to rotate radially outward, thereby increasing the angle at which cutting end 47 engages the formation.

In FIGS. 4 and 6, hinge 45 is shown as a groove or slot in the outside of anchor 42. In FIG. 5, the groove has closed as a result of the bending of anchor 42.

Figure 7:
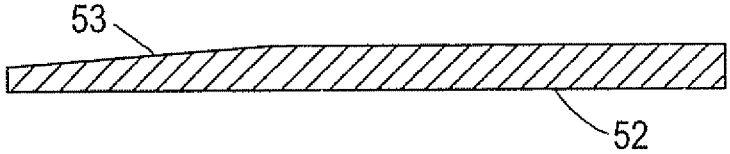
FIGS. 7-11 are enlarged views of alternative anchor configurations suitable for use in the present invention.
Figure 8:
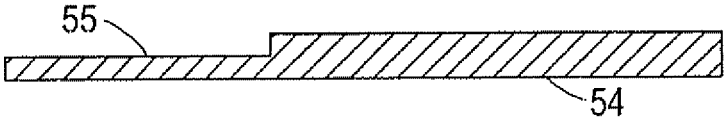
Figure 9:
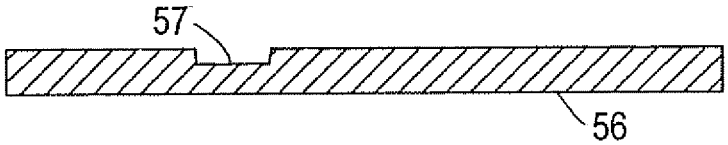

FIGS. 7-10 show alternative embodiments of the anchor. In FIG. 7, an anchor 52 has a tapered first portion 53. In FIG. 8, an anchor 54 has a first portion 55 with a reduced thickness. In FIG. 9, anchor 56 has a hinge comprising a rectilinear notch 57.

Figure 10:
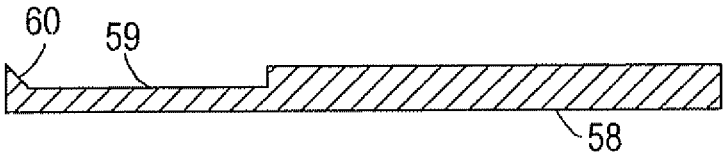

In FIG. 10, anchor 58 has a first portion 59 having a reduced thickness and an enhanced cutting end 60 that includes a wedge- or blade-shaped tip that is thicker than the rest of first portion 59. Two or more of said tips may be arranged successively.

It will be understood that the foregoing are merely illustrative embodiments and that a two-part anchor could have any of an infinite variety of shapes. In each instance, an increase in thickness and therefore in bending force that occurs at the junction between the first portion and the second portion defines a hinge that in turn defines the extent of bending and plastic deformation. Thus, the position of the hinge and the relative length of the first portion determine the reach of the anchor into the formation.

Figure 12:
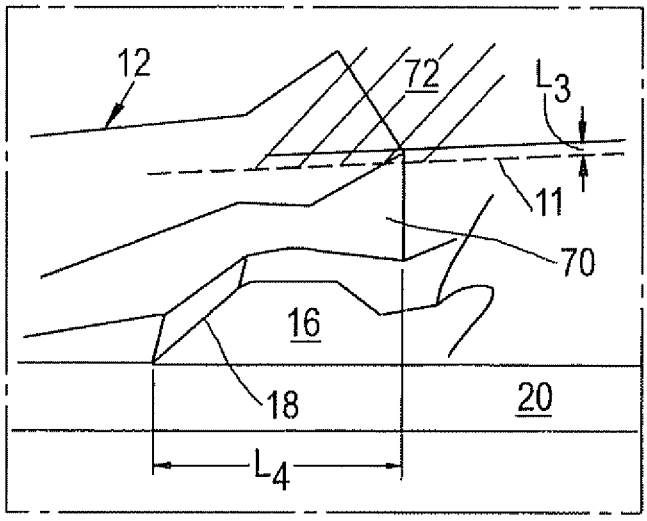
FIG. 12 is an enlarged perspective view of an embodiment of the invention after being expanded.

FIG. 12 shows an anchor 12 having a substantially constant thickness, which after expansion slid onto the wedging member 16. The end of the anchor is provided with the enhanced cutting end 60 that includes a wedge- or blade-shaped tip that is thicker than the rest of the anchor. The cutting end 60 is pushed toward and partly into the formation 72 to anchor the liner in the formation. Penetration depth is schematically indicated with $L_3$. The angle of the ramp member 18 with respect to the axis of the tubular and the contact lengths are designed so as to avoid excessive loading of the liner during pulling of the expansion device through the liner.

The expansion process of the expandable liner 20 actuates the anchoring device of the present invention. Due to the shortening of the liner as the expansion device moves from one end of $L_1$ to the other, the anchor 12 slides onto the ramp 18 of the wedging member 16. In the absence of hinges, the free end of the anchor may overlap the wedging member 16 by a desired longitudinal distance $L_4$ (FIG. 12). The length $L_4$ of the overlap is preferably minimized, in order to limit the increase in expansion force.

The cutting end or tip 60 focuses the radial force that the anchor exerts on the formation during expansion of the liner 20 on the surface of the end of the tip. Thus, the radial force that will be exerted per area of the formation increases. The local resistance or strength of the formation may be expressed as a resistive force per area (e.g. in units psi or Pa). The formation resistance within the wellbore may range between 500 psi up to 16000 psi, and can for instance be measured or estimated. This allows the contact area between the formation and the tip, as well as the corresponding maximum radial force on the tip to be designed such that the tip will penetrate over a predetermined minimum penetration depth L3 into the formation during expansion of the tubular element (FIG. 12).

Improved embodiments of the anchor lock themselves in the formation when they are subjected to an external force. In other words, the design of the anchor imposes that the tip end of the anchor tries to penetrate further into the formation when subjected to such force, as opposed to for instance chafing against the wellbore wall. This is referred to as a self-locking effect. The external force includes for instance the upward force that the expansion device 30 transmits to the tubular 20 during expansion thereof when the expander is beyond the position of the anchoring device 10.

Figure 13:
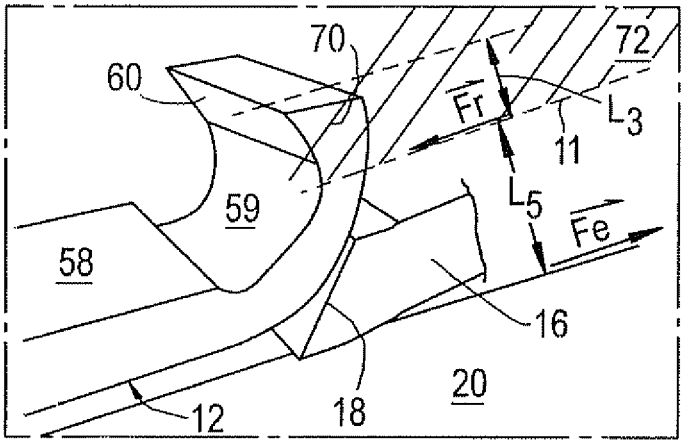
FIG. 13 is an enlarged perspective view of the device of FIG. 10 after being expanded.

FIG. 13 shows an anchor 12, which is provided with the first portion 59 having a reduced thickness after being expanded and subjected to an additional external load. The tip end of the anchor has curled radially outward with respect to the tubular 20 and into the formation when subjected to force.

The tip curls outward, when the force moment acting on the tip end of the anchor is greater than the bending moment $M_h$ of the weakest part of the anchor. In the embodiment of FIG. 13, this is the first portion 59. Typically, the force moment is a function of distance $L_5$ between the wall of the tubular and the formation 72, the external force $F_e$, and the resulting reaction force $F_r$ (FIG. 13). Herein, $F_r$ also depends on the formation hardness and the penetration depth $L_3$, as the formation will crumble or otherwise granulate when the required force $F_r$ per area exceeds the strength (expressed in psi or Pa) of the formation. The above values however may differ on a local scale. Approximately, the anchor will provide a self-locking effect when $M_h < L_5 * F_r$.

Figure 11:
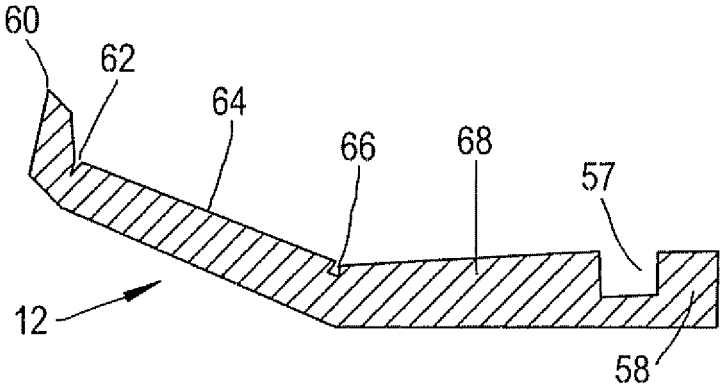
Figure 14:
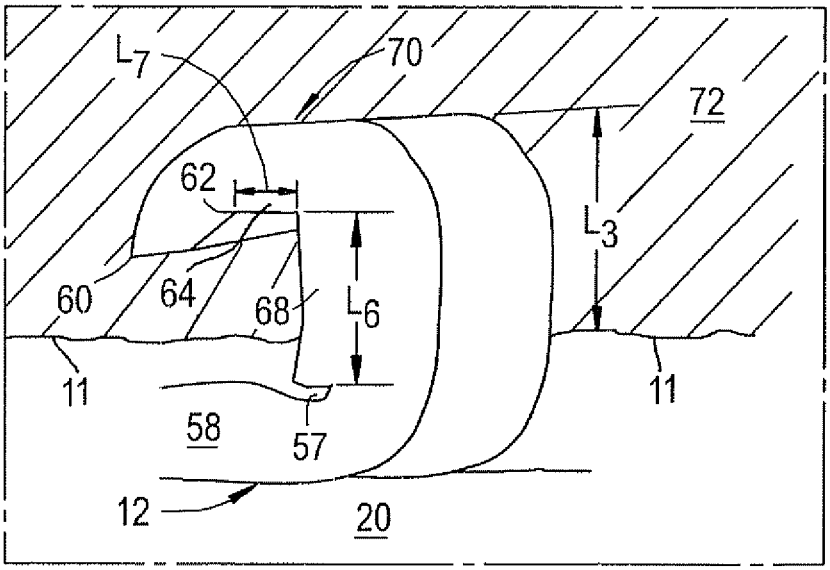
FIG. 14 is an enlarged perspective view of the device of FIG. 11 after being expanded.

In another embodiment, the anchor includes one or more hinges 57, 62, 66 (FIGS. 11, 14). Now, the bending resistance or strength of the anchor is the lowest at the location of the hinges. Similar to the embodiment described above, the tip end 60 of the anchor will curl or bend radially outward and into the formation when subjected to a force that provides a moment that exceeds the bending moment of one or more of the hinges.

Referring to FIGS. 11 and 14, when subjected to force, the anchor 12 will for instance bend first at the point of hinge 62, so that tip 60 starts to curl toward the formation and away from the tubular 20. When the hinge 62 closes, the anchor will bend at the point of hinge 66, so that the tip 60 and section 64 will curl toward the formation and away from the tubular 20. When the hinge 66 closes, the anchor will bend at the point of hinge 57, so that the tip 60, section 64, and section 68 will curl toward the formation and away from the tubular 20. When hinge 57 closes, the anchor will reach the state shown in FIG. 14.

In embodiments where the hinge is provided as a groove or notch (FIGS. 6, 9), the groove or notch may close after some amount of deformation, thus ceasing to operate as a hinge and restricting further deformation (FIG. 14). This is also referred to as self-locking and may be desirable in some instances.

The maximum anchoring force is for instance determined by one or more of the force needed to fold the bending zones 59 or the hinges, the strength of the formation in conjunction with the contact area between the anchors and the formation perpendicular to the axis of the tubular, the penetration depth, the number of anchors disposed around the circumference of the tubular element, etc.

In still other embodiments, more than one hinge may be provided, so that the deformed anchor has a shape such as is illustrated in FIGS. 11 and 14. The length $L_6$, $L_7$ of respective sections between adjacent hinges determines the reach of the anchor in the radial direction. The thicker section in between the hinges prevents the anchor from folding (FIG. 14), thus setting the reach of the anchor into or towards the formation. The maximum anchoring force increases with penetration depth, as the anchoring force depends on the contact area between the anchor and the formation.

Referring to FIG. 14, in embodiments that include one or more hinges, the relatively thicker parts 64, 68, 58 adjacent to the respective hinges will limit this curling movement. The anchor will curl at the position of the hinge, but this curling movement will end when the thicker parts bordering the respective hinge come into contact, as shown in FIG. 14. The lengths $L_6$, $L_7$ of thicker parts 68, 64 thus determine the final shape of the anchor. In the embodiment shown in FIG. 14, for instance, the length $L_6$ determines how far the end of the anchor will extend away from the liner, as adjacent hinges 57, 66 will close and further folding of the anchor can only occur when a greater force is applied thereto. Thus, the length $L_6$ enables the setting of a penetration depth $L_3$, and/or a minimal anchoring force. The penetration depth $L_3$ of the anchor 12 in the formation 72 depends in part on the strength or hardness of the formation.

Figure 15:
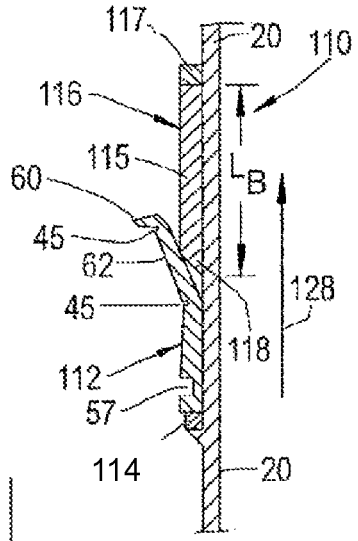
FIG. 15 is a schematic cross-section of another embodiment of the invention in an intermediate level of expansion.
Figure 16:
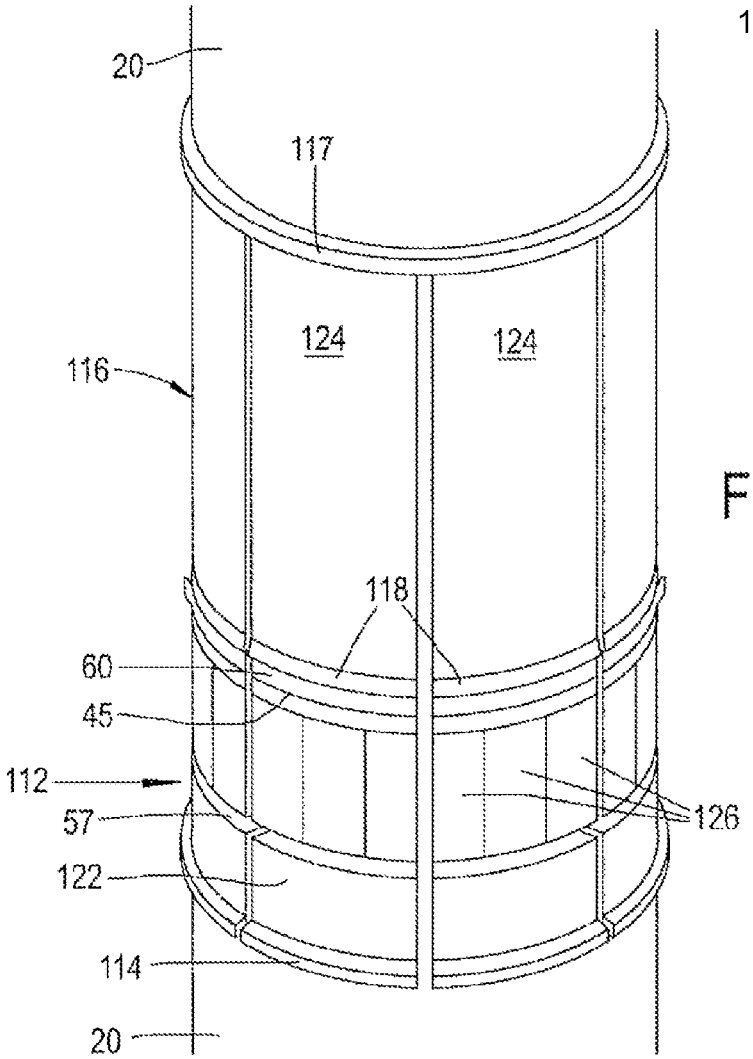
FIG. 16 is a perspective view of the device of FIG. 15

In another embodiment, shown in FIGS. 15 to 17, the anchoring device of the invention aims to provide a maximum upward anchoring force to prevent movement of the liner, and at the same time limit the radial inward force on the liner, which could result in collapse of the liner wall. The part of the anchor 12 that overlaps the wedging member engages and pushes into the formation, and the wall of the liner must be capable of providing a reaction force.

Referring to FIG. 15, an anchoring device 110 constructed in accordance with a second embodiment of the present invention comprises an anchor 112 and a wedging member 116 both mounted on the outside of an expandable tubular 20 and separated by a first distance $L_1$. Anchor 112 includes a fixed end 114 that is preferably affixed to tubular 20 by welding or other means that prevents relative movement between fixed end 114 and tubular 20. The free other end of anchor 112 extends toward wedging member 116 but is not affixed to the outside of tubular 20, so that all of anchor 112 except fixed end 114 is free to move relative to tubular 20. The anchor 112 may be constructed such that its inner diameter is the same as or greater than the unexpanded outside diameter of tubular 20.

Similarly, wedging member 116 includes a fixed end 117 that is preferably affixed to tubular 20 by welding or other means that prevents relative movement between fixed end 117 and tubular 20. The free other end of the wedging member 116 extends toward the anchor 112 and defines a brace 115 having a length $L_B$. Brace 115 is not affixed to the outside of tubular 20 and is free to move relative to the tubular 20. At the free end, wedging member 116 includes a ramp member 118 that extends toward the anchor 112. The ramp 118 may be constructed with any desired surface angle and may be integral with or a separate piece from brace 115.

The thicknesses of wedging member 116 and anchor 112 are a matter of design, but are limited by the maximum allowable diameter of the system prior to expansion, which is smaller than the inner diameter of the previous casing string.

Anchor 112 and wedging member 116 can each have either an annular and/or a segmented construction. In a segmented construction, anchor 112 and/or wedging member 116 may comprise longitudinal strips, rods, or plates. As shown in FIG. 16, the anchor 112 and the wedging member 116 each comprise for instance eight strips 122, 124 respectively. The eight strips 122, 124 extend around the outer circumference of the tubular 20. Optionally, the strips of the anchor 112 and/or the wedging member 116 include a segmented section, comprising strips or fingers 126 which have a smaller width than the strips 122. The anchor and the wedging member may include any number of strips 122 and/or corresponding fingers 126 that is suitable with respect to the size of the tubular 20.

Expandable anchoring device 110 is intended for use in conjunction with an expandable tubular 20, which in turn is expanded by an expansion device 30 as illustrated generally in FIGS. 1 to 3. During expansion, the expansion device moves in the direction of arrow 128.

Figure 17A:
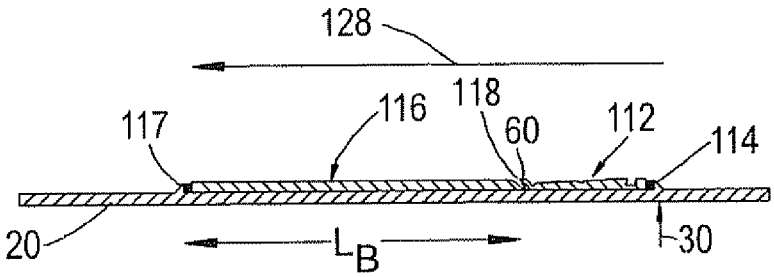
FIGS. 17A-F are sequential cross-sectional illustrations showing operation of the device of FIG. 15.
Figure 17B:
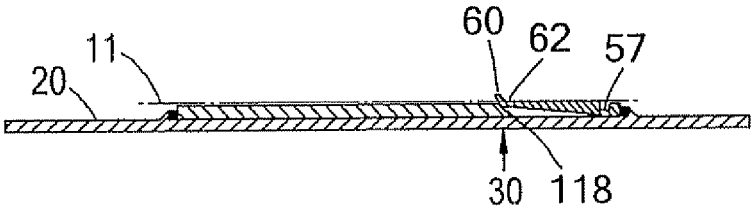

Referring to FIGS. 17A to 17F, it can be seen that as the expansion device (the position of which is indicated by arrow 30) moves through tubular 20, tubular 20 shortens. Initially, the free end of the anchor 112 touches the ramp member 118 (FIG. 17A). Until the expansion device reaches the ramp member, the result of the shortening is that the distance between ramp member 118 and fixed end 114 of the anchor 112 decreases. The free end of the anchor will slide onto the ramp member and toward to borehole wall 11, overlapping the ramp member and extending away from the tubular 20. Preferably, the length of the anchor 112 is chosen such that the free end thereof engages the borehole wall 11 by the time that the expansion device passes ramp 118 (FIG. 17B).

Figure 17C:
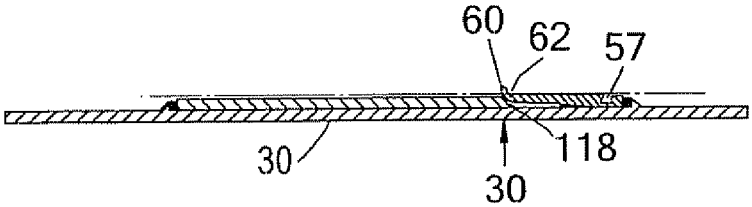
Figure 17D:
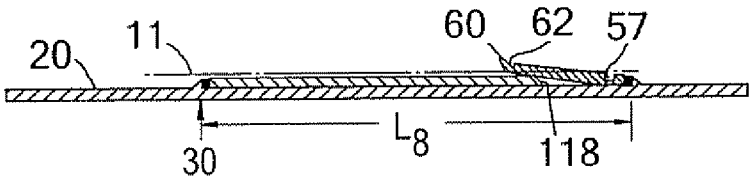
Figure 17E:
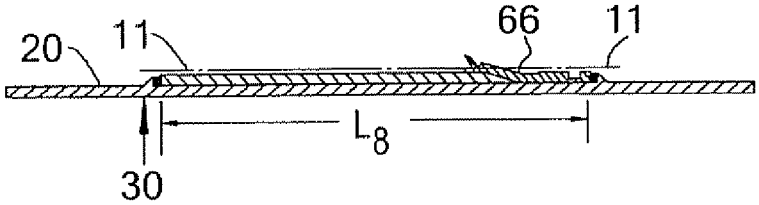
Figure 17F:
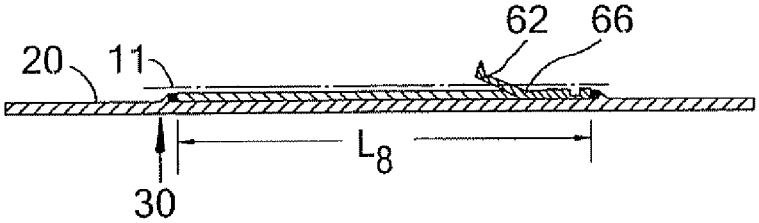

The expansion device subsequently progresses beyond the ramp member, and the tubular 20 continues to expand and shorten at the position of the expander. Due to the shortening, fixed end 117 of wedging member 116 moves toward anchor 112, and as a result ramp member 118 is pushed against anchor 112 (FIG. 17C). If the radial force on the free end of anchor 112, which is induced by shortening of the tubular element 20 due to expansion thereof, is greater than the local resistance or strength of the formation, the tip 60 at the free end will penetrate further into the formation (FIG. 17D).

However, if said radial force is smaller than or equal to the local resistance or strength of the formation, the tip 60 of the anchor will be unable to penetrate further into the formation. In that case, anchor 112 will be held in place by the formation and ramp member 118 will in turn be held in place by anchor 112. With the brace 115 of wedging member 116 unable to slide further along the outside of tubular 20, no further shortening can occur. The final distance between fixed end 117 of wedging member 116 and fixed end 114 of anchor 112 is reached once the expansion device has moved past the fixed end 117 of the wedging member 116, and is defined as $L_8$ (FIG. 17D). Because the tubular is prevented from shortening during a portion of the expansion process, the final overall device length $L_8$ for this embodiment may not be as small as $L_2$ for a device constructed in accordance with the embodiment of FIG. 1 and having the same $L_1$. The difference is a result of the fact that tubular may have been prevented from shortening as it traverses at least some portion of the length $L_B$ of brace 115.

When the free end of the wedging member 116, which comprises the ramp member 118, is held in place by the anchor, the maximum load that is applied to the wall of the liner 20 is about equal to the so-called fixed-fixed load. The fixed-fixed load is the local load that is applied to the liner wall when the expander moves between two points at which the liner is fixed, such that the liner cannot shorten between the two points. As the fixed-fixed load can be determined beforehand, for instance during lab tests, the anchoring device 10 of the invention can be designed such that the radial force exerted on the formation does not exceed the maximum radial load of the wall of the tubular 20. Thus, the anchoring device of the present invention ensures that the tubular wall can be sufficiently strong to withstand the maximum radial force during expansion, so that the wall will remain substantially cylindrical, i.e. circular, when the anchor engages the formation.

The embodiment shown in FIGS. 15 to 17 allows the expandable tubular to be designed so as to avoid collapse, even in the event that the formation is too hard to receive anchor 112, as the maximum load on the tubular wall will not exceed the fixed-fixed load, which can be calculated or at least determined empirically. This will prevent collapse, rupture, or similar damage to the tubular wall during expansion. As indicated above, if the expandable element were damaged, the entire downhole section could be rendered useless and would then have to be removed, at considerable costs. The expandable tubular arrangement of the present invention thus greatly improves reliability in this respect.

The radial load during expansion on the liner and on the formation depends for instance on one or more of the surface angle of the ramp 118, the friction between the wedging member 116 and the liner 20, the friction between the wedging member and the anchor 112, the formation hardness, the distance between the tubular wall and the formation during expansion, etc. The surface angle of the ramp is preferably designed such that a maximum radial force is applied, whereas at the same time the radial load remains within the radial collapse load of the liner.

As the radial and axial load on the wall of the tubular is limited, the embodiment of FIGS. 15 to 17 is suitable for relatively hard formations, such as those, for example, having a strength or hardness of for instance 3000 (20 MPa) to 4000 psi (28 MPa) or more. In addition, the radial load on the tubular wall can be limited by limiting the overlap between the anchor and the wedging member, and/or by limiting the contact area between the anchor and the formation. The contact area between the anchor and formation perpendicular to the radius of the tubular is minimized to reduce the radial loading on the liner. In a practical embodiment, the surface angle of the ramp 118 is in the range of 30 to 60 degrees, for instance about 45 degrees.

Figure 18:
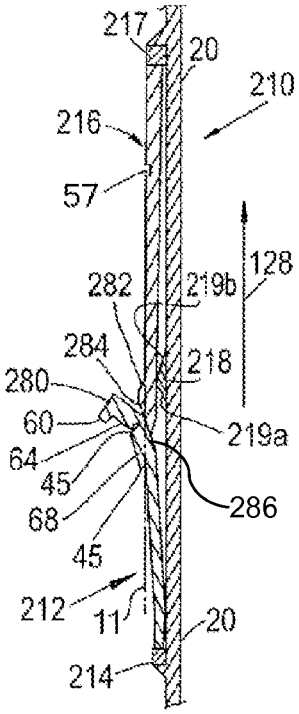
FIG. 18 is a schematic cross-section of still another embodiment of the invention in an intermediate level of expansion.

Referring to FIG. 18, an anchoring device 210 constructed in accordance with still another embodiment of the present invention comprises an anchor 212 and a wedging member 216 both mounted on the outside of an expandable tubular 20. The anchor 212 includes a fixed end 214 that is preferably affixed to tubular 20 by welding or other means that prevents relative movement between fixed end 214 and tubular 20. The free other end of the anchor 212 extends toward wedging member 216 and is not affixed to the outside of tubular 20, so that all of anchor 212 except fixed end 214 is free to move relative to tubular 20. The anchor 112 may be constructed such that its inner diameter is the same as or greater than the unexpanded outside diameter of tubular 20.

Likewise, the wedging member 216 includes a fixed end 217 that is preferably affixed to tubular 20 by welding or other means that prevents relative movement between fixed end 217 and tubular 20. The free other end of the wedging member 216 extends toward anchor 112 and is not affixed to the outside of tubular 20, so that all of wedging member 216 except fixed end 217 is free to move relative to tubular 20. The wedging member 216 may be constructed such that its inner diameter is the same as or greater than the unexpanded outside diameter of tubular 20.

A ramping member 218 is disposed between the free ends of anchor 212 and wedging member 216. Ramping member 218 includes an anchor ramp face 219*a*, which tapers in the direction of anchor 216, and a wedging ramp face 219*b*, which tapers in the direction of wedging member 216. Ramping member 218 is preferably affixed to the outside of tubular 20 so as to prevent relative movement therebetween.

The free end of anchor 212 may be provided with a tip 60, having a slanted side 280 facing tubular 20. Slanted side 280 cooperates with anchor ramp face 219*a*. The free end of wedging member 216 may be provided with a thickened end 282, having a slanted top surface 284 and a slanted bottom surface 286. Slanted surface 284 cooperates with anchor 218 as shown in FIG. 18. The slated bottom surface cooperates with wedging ramp face 219*b*.

Figure 19:
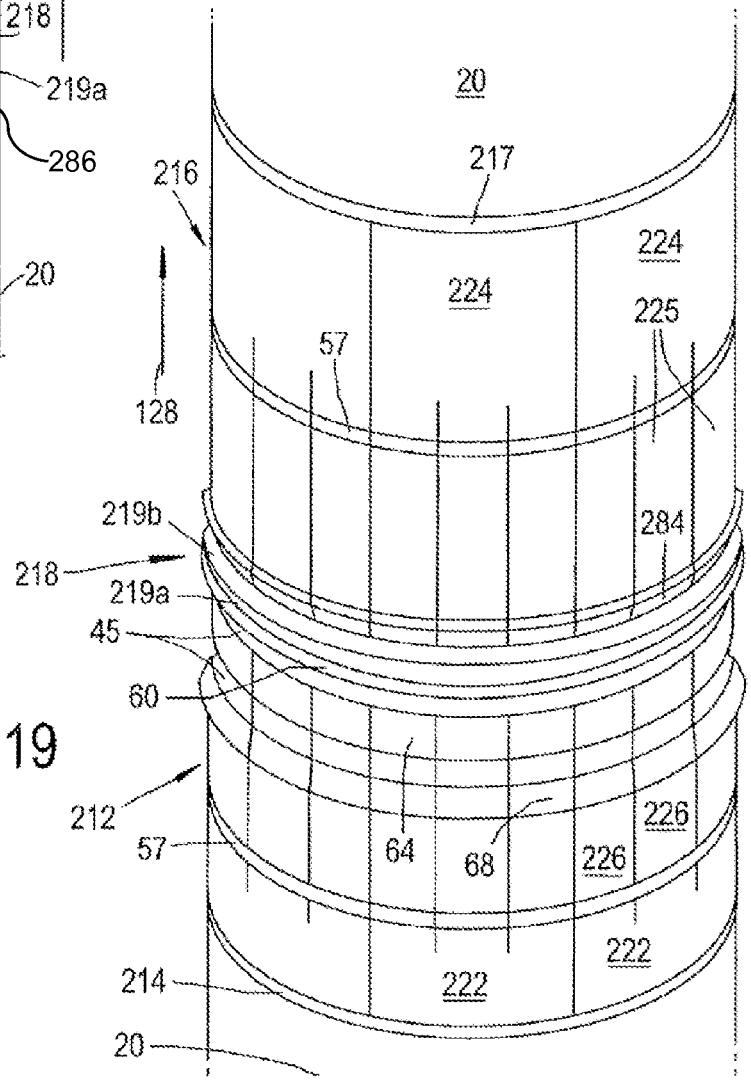
FIG. 19 is a perspective view of the device of FIG. 18.

Anchor 212 and wedging member 216 can each have either an annular and/or a segmented construction. In a segmented construction, anchor 212 and/or wedging member 216 may comprise longitudinal strips, rods, or plates. As shown in FIG. 19, the anchor 212 and the wedging member 216 each comprise for instance eight strips 222, 224 respectively. The eight strips 122, 124 extend around the outer circumference of the tubular 20. Optionally, the strips of the anchor 212 and/or the wedging member 216 include a segmented section, comprising strips or fingers 225, 226 which have a smaller width than the strips 122. The anchor and the wedging member may include any number of strips 222 and/or corresponding fingers 226 that is suitable with respect to the size of the tubular 20.

Figure 20A:
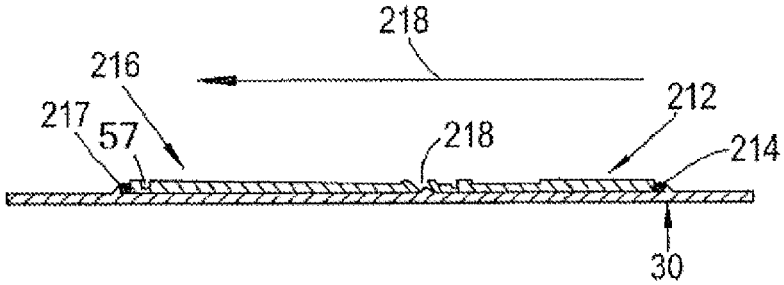
FIGS. 20A-F are sequential cross-sectional illustrations showing operation of the device of FIG. 18.
Figure 20B:
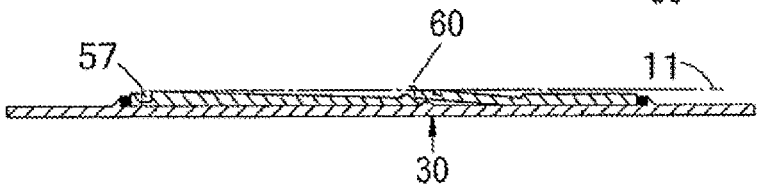
Figure 20C:
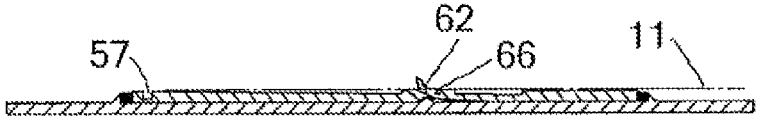

Referring to FIGS. 20A to 20F, it can be seen that as the expansion device (the position of which is indicated by arrow 30) moves through tubular 20, tubular 20 shortens. Initially, the free end of the anchor 212 touches the ramp surface 219*a* (FIG. 20A). Until the expansion device reaches the ramp member, the result of the shortening is that the distance between ramp member 218 and fixed end 214 of the anchor 212 decreases. The free end of the anchor will slide onto the ramp surface 219*a* of the ramp member and toward to formation, overlapping the ramp member and extending away from the tubular 20. Preferably, the length of the anchor 212 is chosen such that the free end thereof touches or extends into the formation (FIG. 17B).

Figure 20D:
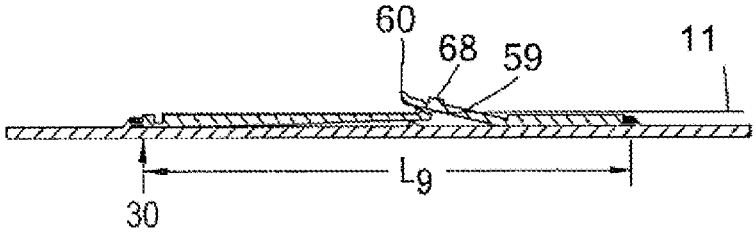
Figure 20E:
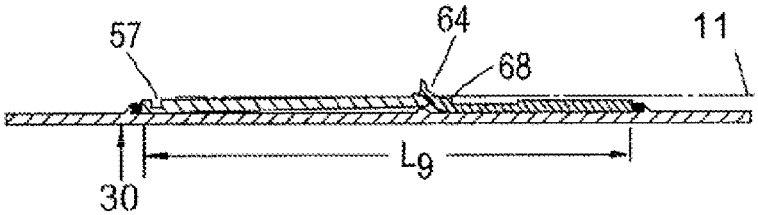
Figure 20F:
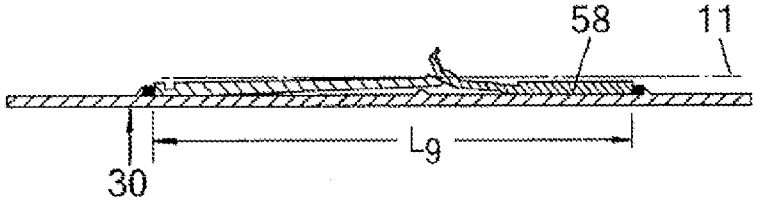

The expansion device subsequently progresses beyond the ramp member 218, and the tubular 20 continues to expand and shorten at the position of the expander. Due to the shortening, fixed end 217 of wedging member 216 moves toward ramp member 218, and as a result the bottom surface 286 slides onto the ramp surface 219*b*, wherein the top surface 284 is pushed against anchor 212 (FIGS. 20D, 20E). If the radial force, which is induced by shortening of the tubular 20 due to expansion thereof, on the free end of anchor 212 exceeds the local resistance or strength of the formation, the free end will penetrate further into the formation (FIG. 20D). However, if said radial force at the free end of anchor 212 is smaller than or equal to the local resistance or strength of the formation, the tip 60 of the anchor will be unable to penetrate the formation. In that case, anchor 212 will be held in place by the formation and the free end of wedging member 216 will in turn be fixated against the anchor 212. With the free end of ramp member 218 unable to slide further along the outside of tubular 20, no further shortening can occur. The final distance between fixed end 217 of wedging member 216 and fixed end 214 of anchor 212 is reached once the expansion device has moved past the fixed end 217 of the wedging member 216, and is defined as $L_9$ (FIG. 20D). Because the tubular is prevented from shortening during a portion of the expansion process, $L_9$ is not as small as $L_2$ for a given $L_1$.

When the free end of wedging member 216 is held in place by the anchor, the maximum load that is applied to the wall of the liner 20 is about equal to the so-called fixed-fixed load. The fixed-fixed load is the local load that is applied to the liner wall when the expander moves between two locations at which the liner is fixed, such that the liner cannot shorten between the two positions. As the fixed-fixed load can be determined beforehand, for instance during lab tests, the liner wall can be designed to be sufficiently strong to withstand the load during expansion, so that collapse of the wall of the expandable tubular can be prevented. Consequently, the device of FIGS. 18-20 is suitable for both soft and hard formation. The anchor 212 can however extend further away from the tubular wall and into the formation than the anchors 12, 112, as the wedging member 216 can push the anchor toward and into the formation. The anchor 212 can extend for instance about two to three times further into the formation.

In a practical embodiment, the expandable tubular element may be expanded such that its radius increases up to about 30%, for instance about 10 to 15%. The length of the tubular may shorten for instance 5 to 10%.

For a tubular element having an external diameter of 9⅝ inch, the anchor and/or wedging members may have a thickness in the range of 0.3 to 1 inch (1 to 2.5 cm), for instance about 0.5 inch (1.2 cm). The ramp may typically have an angle with respect to the axis of the tubular element in the order of 30 to 60 degrees, for instance about 45 degrees. The overlap $L_4$ is for instance 0.5 to 2 inch (1 to 5 cm). The length of the anchor may be in the range of 3 to 16 inch (7.5 to 40 cm). The length of the brace $L_B$ may be in the range of 4 to 20 inch (10 to 50 cm). The minimum penetration depth $L_3$ may be in the range of 0.2 to 1 inch (5 to 25 mm). The length $L_5$ may be in the range of 1 to 4 inch (2 to 10 cm). The length $L_6$ may be in the range of 1 to 8 inch (2 to 20 cm).

A single anchoring device provided around the circumference of the tubular can provide an anchoring force up to for instance 3 to 4 MN, for instance about 2 MN. The tubular may be provided with any number of consecutive anchoring devices, to increase the maximum anchoring force. The anchoring device of the invention can be scaled up or down to match any size of expandable tubular element that is commonly used when drilling for hydrocarbons. The force that is required to expand the expandable tubular element may increase locally for instance about 5% to 50% along the length of the anchoring member of the invention. The expansion force increases for instance about 10% to 20% at the position of the welds 14, 17. At the position of the ramp member, the expansion force may increase about 20% to 40% when the tip 60 engages the formation. During fixed-fixed expansion, as described with respect to the FIGS. 17 and 20, the expansion force may increase in the range of about 5 to 20%, for instance about 10%.

In a practical embodiment of the device shown in FIGS. 18-20, the angle of anchor ramp face 219*a* with respect to the tubular axis may be in the range of 40 to 50 degrees, for instance about 45 degrees. The angle of wedging ramp face 219*b* with respect to the tubular axis is for instance in the range of 25 to 40 degrees, for instance about 30 degrees.

The angle of the slanted top surface 284 with respect to the tubular axis is in the range of 30 to 45 degrees, for instance about 38 degrees. This angle is chosen to create a sufficiently large area between the anchor 212 and the wedging member 216 to avoid yielding and stimulate relative sliding of the two components. The angle of the slanted bottom surface 286 with respect to the tubular axis is about equal to the angle of wedging ramp face 219*b* (for instance about 45 degrees) to ensure sufficient contact between the two components during expansion.

All exemplary sizes and shapes provided above could be scaled and adapted to the external diameter of any expandable tubular element that is typically used for the exploration and production of hydrocarbons.

The present invention is not limited to the above-described embodiments thereof, wherein many modifications are conceivable within the scope of the appended claims. Features of respective embodiments can for instance be combined.

The invention claimed is:

1. A system for anchoring an expandable tubular to a borehole wall, comprising:

a support member having a first support end fixed relative to the outside of the expandable tubular; and an anchor member having a first anchor end fixed relative to the outside of the expandable tubular and a second anchor end extending toward the support member, said second anchor end being movable relative to the outside of the expandable tubular;

said support member having a second support end including a ramp surface that tapers in the direction of said anchor member, wherein said ramp surface is axially spaced apart from said first support end by a distance $L_B$ and wherein said support member includes a brace extending between said first support end and said second support end, said brace and said second support end being movable relative to the outside of the expandable tubular;

said first anchor end and said first support end defining an initial axial device length $L_1$ therebetween; wherein $L_1$ is selected such that expansion of the portion of the expandable tubular between the first anchor end and the ramp surface of the second support end causes the axial device length to shorten to $L_2$, wherein the difference between $L_1$ and $L_2$ is sufficient to cause the second anchor end to move radially outward and engage the borehole wall as a result of engagement with said ramp surface, and wherein the expandable tubular and brace are designed so that expansion of the portion of the expandable tubular between the ramp surface and the first support end causes the axial device length to shorten further unless the borehole wall prevents shortening, whereupon the expandable tubular will be prevented from shortening further by the brace.

2. The system according to claim 1 wherein $L_1$ is less than or about twice as great as $L_B$.

3. The system according to claim 2, wherein $L_1$ is about 1.2 to about 1.6 times as great as $L_B$.

4. The system according to claim 1 wherein the anchor member and/or the support member includes at least two segments extending longitudinally along the expandable tubular.

5. The system according to claim 4, wherein the at least two segments include strips or plates that enclose substantially the circumference of the expandable tubular.

6. The system according to claim 4, wherein at least one of the segments includes a segmented section, including strips or fingers having a width that is smaller than the width of the respective segment.

7. The system according to claim 1, wherein said anchor member includes at least one hinge between said first anchor end and said second anchor end, wherein the bending moment required to bend said anchor member at the hinge is less than the bending moment required to bend another portion of said anchor member.

8. The system according to claim 7 wherein the hinge includes a reduced-thickness portion on the outside of the anchor member.

9. The system according to claim 8 wherein the reduced-thickness portion is sized so as to cease operating as a hinge after a predetermined amount of bending has occurred.

10. The system according to claim 9, wherein the hinge is sized to cease to operate when thicker portions bordering opposite sides of the reduced-thickness portion contact each other.

11. The system according to claim 7 wherein the anchor member includes at least two hinges that are axially spaced apart.

12. The system according to claim 11 wherein the distance $L_6$ between the at least two hinges is selected so as to provide a predetermined amount of radial extension of the anchor member once expansion of the expandable tubular through the system is complete.

* * * * *